US010842337B2

(12) United States Patent
Persson et al.

(10) Patent No.: US 10,842,337 B2
(45) Date of Patent: Nov. 24, 2020

(54) SAFETY ARRANGEMENT AND METHOD FOR A FLOOR SURFACING MACHINE

(71) Applicant: HUSQVARNA AB, Huskvarna (SE)

(72) Inventors: Johan Persson, Öjersjö (SE); Johan Berg, Alingsås (SE); Magnus Rosén, Alingsås (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 16/341,145

(22) PCT Filed: Oct. 12, 2017

(86) PCT No.: PCT/SE2017/051006

§ 371 (c)(1),
(2) Date: Apr. 11, 2019

(87) PCT Pub. No.: WO2018/074965

PCT Pub. Date: Apr. 26, 2018

(65) Prior Publication Data

US 2019/0239712 A1 Aug. 8, 2019

(30) Foreign Application Priority Data

Oct. 17, 2016 (SE) ..... 1651353

(51) Int. Cl.
*B24B 7/18* (2006.01)
*B24B 23/02* (2006.01)
(Continued)

(52) U.S. Cl.
CPC ..... *A47L 11/4011* (2013.01); *A47L 11/14* (2013.01); *A47L 11/16* (2013.01); *A47L 11/4066* (2013.01);
(Continued)

(58) Field of Classification Search
CPC ..... B24B 7/18; B24B 7/186; B24B 23/02; B24B 27/0007; A47L 11/08; A47L 11/14;
(Continued)

(56) References Cited

U.S. PATENT DOCUMENTS 3,212,218 A * 10/1965 Sams ..... A47L 11/10 451/350
3,412,415 A * 11/1968 Brab ..... A47L 11/16 15/50.1
(Continued)

FOREIGN PATENT DOCUMENTS

CN 1256383 A 6/2000
CN 102785169 A 11/2012
(Continued)

OTHER PUBLICATIONS

International Search Report and Written Opinion for International Application No. PCT/SE2017/051006 dated Nov. 30, 2017.
(Continued)

*Primary Examiner* — Eileen P Morgan
(74) *Attorney, Agent, or Firm* — Burr & Forman, LLP

(57) ABSTRACT

The present invention relates to a safety arrangement for a floor surfacing machine (1) comprising at least one drive wheel (3, 4), a motor arrangement (5, 6) for propelling said drive wheel (3, 4), a surfacing apparatus (13) and a control unit (10, 11*a*) for controlling the operation of said motor arrangement (5, 6) and said surfacing apparatus (13). The arrangement comprises at least one detecting unit (55; 56, 57) connected to said control unit (10,11*a*) and adapted for determining a torque required for operating each drive wheel (3, 4) wherein said control unit (10,11*a*) is configured for preventing operation of said surfacing apparatus (13) if said required torque is lower than a predetermined limit value.
(Continued)

The invention also relates to a method for obtaining safety in a floor surfacing machine (1).

13 Claims, 6 Drawing Sheets

(51) Int. Cl.
*A47L 11/14* (2006.01)
*A47L 11/40* (2006.01)
*A47L 11/16* (2006.01)

(52) U.S. Cl.
CPC ..... *A47L 11/4069* (2013.01); *B24B 7/18* (2013.01); *B24B 7/186* (2013.01); *B24B 23/02* (2013.01)

(58) Field of Classification Search
CPC ... A47L 11/16; A47L 11/4066; A47L 11/4069
USPC ..... 451/350, 353
See application file for complete search history.

(56) References Cited

U.S. PATENT DOCUMENTS 4,232,980 A * 11/1980 Tertinek ..... E04F 21/248 192/129 R
4,317,314 A * 3/1982 Carlstrom ..... B24D 7/16 451/353
4,435,870 A * 3/1984 Tucker ..... A47L 11/4075 15/49.1
4,542,551 A * 9/1985 Phillips ..... A47L 11/162 15/49.1
4,757,566 A 7/1988 Field et al.
5,369,236 A * 11/1994 Nickels, Jr. ..... H01H 3/02 200/329
5,435,035 A 7/1995 Fujimoto et al.
6,231,432 B1 5/2001 Peterson et al.
7,731,618 B2 6/2010 Burlington et al.
2003/0226225 A1* 12/2003 Graceffo ..... A47L 11/162 15/98
2005/0109134 A1 5/2005 Barnett et al.
2010/0190422 A1* 7/2010 Mann, Jr. ..... B24B 7/186 451/353
2013/0189908 A1* 7/2013 Strickland ..... A47L 11/16 451/259
2013/0292915 A1* 11/2013 Esenwein ..... B24B 23/02 279/140
2019/0039228 A1* 2/2019 Matsushita ..... B25F 5/00

FOREIGN PATENT DOCUMENTS

CN 104737423 A 6/2015
CN 104856614 A 8/2015
CN 105946915 A 9/2016
DE 4032985 C2 4/1995
EP 1 492 646 A1 1/2005
EP 2 110 295 A2 10/2009
JP H064130 A 1/1994
WO 2016/048213 A1 3/2016

OTHER PUBLICATIONS

International Type Search Report & Office Action for Swedish Application No. 540015 dated May 12, 2017.
International Preliminary Report on Patentability for International Application No. PCT/SE2017/051006 dated Apr. 23, 2019.

* cited by examiner

SAFETY ARRANGEMENT AND METHOD FOR A FLOOR SURFACING MACHINE

TECHNICAL FIELD

The present disclosure relates to a safety arrangement for a floor surfacing machine and comprising at least one drive wheel, a motor arrangement for propelling said drive wheel, a surfacing apparatus and a control unit for controlling the operation of said motor arrangement and said surfacing apparatus.

The present invention also relates to a method for obtaining safety in a floor surfacing machine having at least one drive wheel, a motor arrangement for propelling said drive wheel, and a surfacing apparatus. The method comprises controlling the operation of said motor arrangement and said surfacing apparatus by means of a control unit.

BACKGROUND

A floor surfacing machine such as a floor grinding machine is commonly used to strip or smooth a rough flooring surface by grinding undesired material. In this manner, a clean, smooth and essentially flat surface to which new coverings or coatings can be applied may be provided. Certain surfaces, including some types of concrete, are particularly suitable for treatment by a floor surfacing machine. A floor surfacing machine is used for treating floors in commercial or public environments such as hotels, factories, schools and offices, but it is also used for floors in private homes.

One common type of floor surfacing machine is the planetary-type machine. This type of machine normally comprises a chassis or frame which supports two wheels and also a planetary head having two to four, or even more, satellite grinding heads. The satellite grinding heads may be driven in one direction and the planetary head in another direction. It is previously known to use a first motor for driving the planetary head and a second motor for driving the satellite grinding heads. These two motors are normally electric motors. The direction of rotation of the planetary head on the one hand, and the satellite grinding heads on the other hand, can be controlled independently in order to obtain suitable floor grinding characteristics.

When a floor grinding machine is used, an operator may advance the machine along a floor surface to be treated. It is also known to implement a floor grinding machine in a manner so that it may be controlled remotely. In such a case, the operator does not have to be positioned so as to manually advance the machine, but can be positioned nearby so as to monitor the machine and to control its movements by means of a remote control.

In order to provide remote control of a floor grinding machine, it comprises a drive motor arrangement which is operably connected with two or more drive wheels in order to move the machine along the floor to be treated. Furthermore, a remote control unit is used by the operator in a wireless manner so as to control the operation of the drive motor arrangement, and also to control the operation of the planetary head motor, the motor of the satellite grinding heads and other required parameters of the machine.

A floor grinding machine which is arranged to be remotely controlled in this manner is previously known from the patent document EP 1492646. In this case, the operator is not required to continuously steer the machine, but can concentrate on monitoring the grinding result and if necessary increase or reduce the rate of advancement, or removing any obstacles or even controlling more than one floor surfacing machine simultaneously.

In a remotely controlled floor grinding machine, it is important that the drive motor arrangement is connected to the drive wheels before the grinding operation is started by an operator. A floor grinding machine is very heavy, normally with a weight which is approximately 500 kilos, and also rests heavily on its planetary head when it is not in operation. If the planetary head and its satellite grinding heads are activated without also operating the drive wheels, the entire machine may start moving on its own on the floor. In particular, if one of the two drive wheels is not operated, a situation may occur in which the machine may start to rotate. Consequently, a problem exists in the form of a risk that the machine may move freely along the floor and cause damage and possibly also personal injuries.

Consequently, for reasons for safety, it is essential that the drive motor is fixed to the drive wheels before the grinding operation is initiated. A previously known solution for locking the drive wheels is to use a locking pin for each wheel. The locking pin may be arranged in the wheel in a manner so as to lock the wheel to an outgoing drive axle of the drive motor.

However, this known solution has a disadvantage in that it may be difficult to verify whether the locking pins actually are in their locked position. Also, there may be a risk that an operator forgets to arrange the locking pins in a correct manner in their locked positions. If a locking pin is not arranged in the locking position, the wheels are not fixedly coupled to the outgoing drive motor axle. As a consequence, a situation as explained above, in which the machine may start moving, may then occur.

SUMMARY

It is an object of the present invention to provide a remotely controlled floor surfacing machine offering improved safety, in particular in a situation in which an operator has forgotten to lock the wheels to the outgoing drive motor axle.

Said object is obtained by means of a safety arrangement for a floor surfacing machine and comprising at least one drive wheel, a motor arrangement for propelling said drive wheel, a surfacing apparatus and a control unit for controlling the operation of said motor arrangement and said surfacing apparatus.

Furthermore, said arrangement comprises at least one detecting unit connected to said control unit and adapted for determining a torque required for operating each drive wheel. Also said control unit is configured for preventing operation of said surfacing apparatus if said required torque is lower than a predetermined limit value.

An important advantage of the invention is that the control unit can be used to check if the motor arrangement is operated without resistance or if a high torque is required in order to rotate an outgoing axle of the motor arrangement. If the motor arrangement needs a relatively high torque to be operated, the wheel or wheels are considered to be locked by the locking pin or similar arrangement. This means that the grinding operation can start. On the other hand, if the motor arrangement is operated without any resistance, it can be assumed that the wheel or wheels are not locked. In such as situation, the surfacing apparatus cannot be operated.

Consequently, the invention provides a system which protects a user of a grinding machines from a hazardous scenario. Any potential safety risks being caused by an operator who forgets to lock the wheels by means of a locking pin can be avoided.

According to an embodiment said motor arrangement comprises at least one brushless DC motor, which is a motor type suitable for a floor surfacing machine.

Furthermore, according to an embodiment the surfacing apparatus comprises a planetary head which is rotatably mounted to a frame structure, and at least one satellite surfacing head which is rotatably mounted on the planetary head. Also, a second motor arrangement for propelling said planetary head and said satellite surfacing head is provided.

Also, according to an embodiment, said second motor arrangement comprises a motor which is arranged to propel the satellite surfacing heads and a further motor which is arranged to propel the planetary head, in a manner so that the planetary head and the satellite surfacing heads are independently operable.

Also, according to an embodiment, the detector comprises a current measuring unit being configured for detecting the current supplied to said motor arrangement, said current being indicative of the torque required for operating each corresponding drive wheel.

Also, according to an embodiment, the above-mentioned detector comprises a Hall sensor being configured for detecting the speed of at least one output axle of said motor arrangement.

Also, according to an embodiment, the control unit is at least partly provided in a remote control. This means that the floor surfacing machine can be controlled both manually and by remote control.

Furthermore, according to an embodiment, said at least one drive wheel is associated with a locking pin which is configured to lock said at least one drive wheel to said at least one output axle of said motor arrangement. This is an efficient and reliable way of locking said drive wheel.

The above-mentioned object is also obtained by means of a method for obtaining safety in a floor surfacing machine having at least one drive wheel, a motor arrangement for propelling said drive wheel, and a surfacing apparatus. The method comprises controlling the operation of said motor arrangement and said surfacing apparatus by means of a control unit. The method further comprises: determining a torque required for operating said at least one drive wheel; determining whether said required torque is lower than a predetermined limit value; and preventing operation of the surfacing apparatus if said required torque is lower than said predetermined limit value.

BRIEF DESCRIPTION OF THE DRAWINGS

The present invention will now be described more in detail with reference to the appended drawings, where.

DETAILED DESCRIPTION

Different aspects of the present disclosure will be described more fully hereinafter with reference to the enclosed drawings. The method and system disclosed herein can, however, be realized in many different forms and should not be construed as being limited to the aspects set forth herein.

Figure 1:
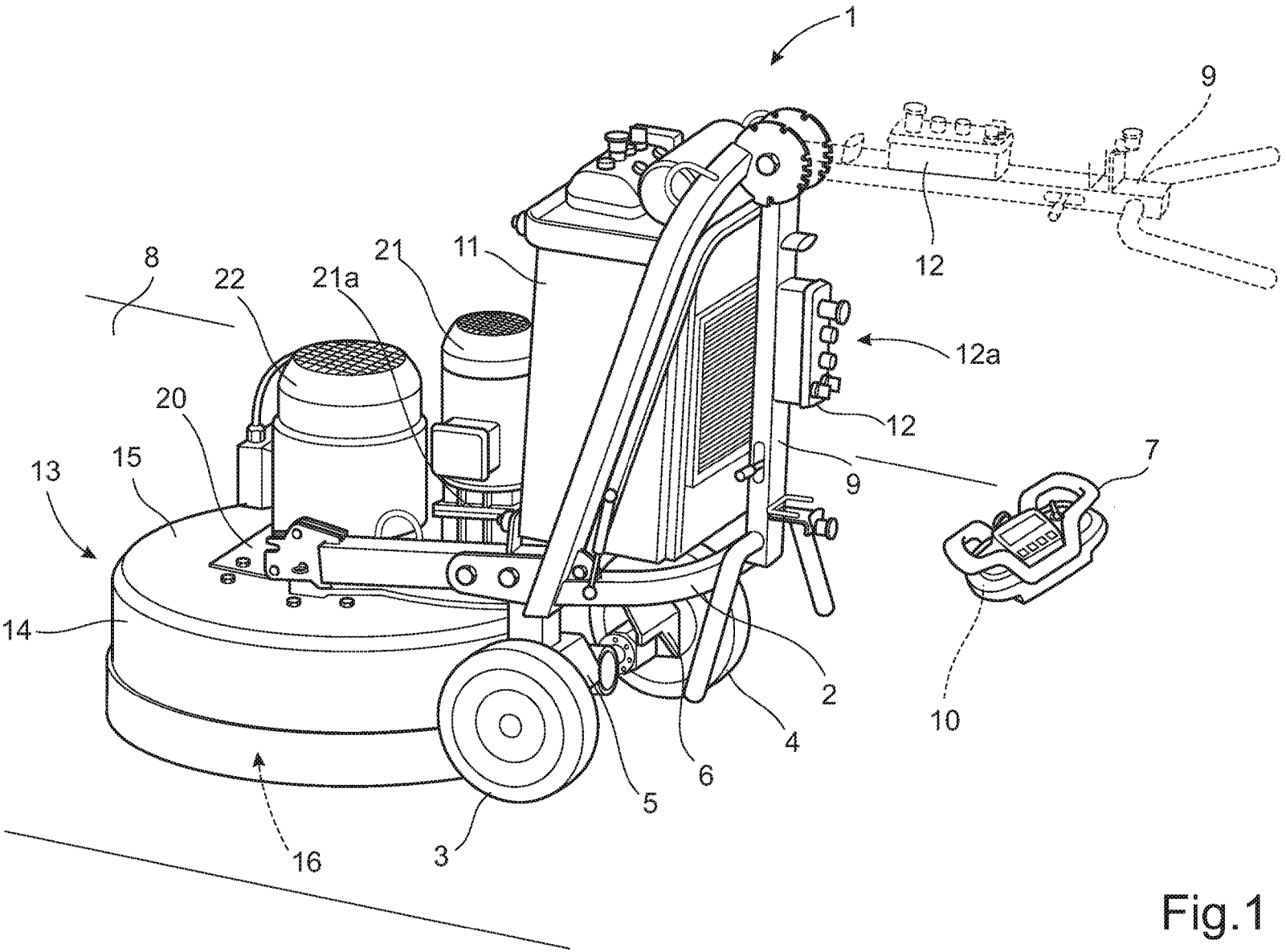
FIG. 1 shows a perspective view of a floor surfacing machine.

FIG. 1 shows a perspective view of a floor surfacing machine 1, which according to an embodiment is in the form of a floor grinding or polishing machine. The floor surfacing machine 1 has a frame 2 which is carried by a first wheel 3 and a second wheel 4. The first wheel 3 is operated by means of a first drive motor 5, whereas the second wheel 4 is operated by means of a second drive motor 6. According to an embodiment, the floor surfacing machine 1 can be operated remotely, i.e. it can be operated by an operator who is standing beside the machine 1 and is using a remote control 7 for controlling various operating parameters. More precisely, the remote control 7 is used to control the operation of the two drive motors 5, 6 so as to control the speed of each wheel 3, 4 independently. By varying the speed of the left and right wheel 3, 4, respectively, the floor surfacing machine 1 can be made to turn to the right or left direction. The remote control 7 can also be used to control additional parameters required for the floor grinding operation.

In this manner, the floor surfacing machine 1 can be moved over a floor surface 8 in order to implement for example a grinding or polishing process. The process for treatment of the floor surface 9, including the manner in which the remote control 7 can be used for controlling a grinding process, will be described in greater detail below.

According to a further embodiment, the floor surfacing machine 1 can be operated manually, i.e. it can be operated by an operator who will then be moving the machine 1 over the floor surface 8. To this end, the machine 1 is equipped with a handle 9 which the operator then uses to maneouvre the machine 1 along the floor 8 as required. In FIG. 1, the handle 9 is shown in a condition in which it is folded together, and also in an unfolded condition (which is indicated with broken lines) in which it is suitable for manual operation of the floor surfacing machine 1. The handle 9 is suitably configured to assume one or more further positions which are not shown in FIG. 1. For example, the handle 9 can be configured to assume a condition in which it extends in a generally vertical direction. Such a condition is suitable when the floor grinding machine 1 is operated by means of the remote control 7.

The remote control 7 is provided with a control unit 10 which, during remote operation of the floor grinding machine 1, is configured for communicating wirelessly with a main control unit (not visible in FIG. 1) which is arranged inside an electrical cabinet 11. Also, the handle 9 is provided with a handle control panel 12 which is used to operate the machine 1 during a manual mode of operation, and which also supports a panel control unit (not visible in FIG. 1) which is configured to communicate with the above-mentioned main control unit, suitably via a wired connection.

When remotely controlling the floor surfacing machine 1, an operator should be positioned so as to have a clear view of the floor surfacing machine 1 and the floor surface 8 that is to be treated, suitably by being in the immediate vicinity of the floor surfacing machine 1 and the floor surface 8. The operation of the machine 1 is then controlled by means of the remote control 7.

On the other hand, during manual control of the floor surfacing machine 1, an operator is able to control and steer the floor surfacing machine 1 by means of the handle arrangement 9 and the handle control panel 12 in a conventional way, manually guiding the floor surfacing machine 1 along the floor surface 8.

Figure 2:
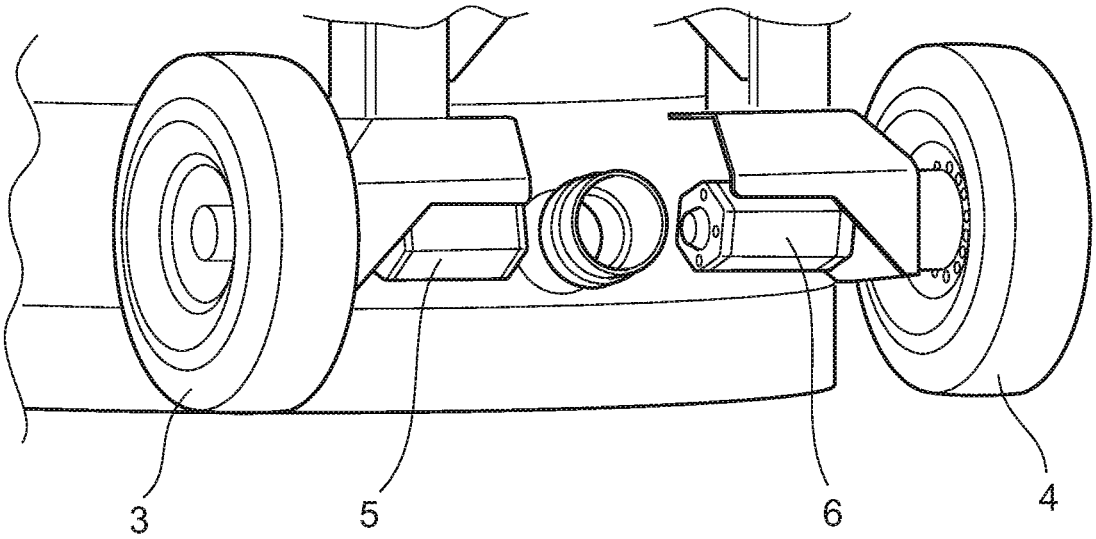
FIG. 2 shows a perspective view of two drive wheels and two drive motors.

As shown in FIG. 1 and also in FIG. 2, the first drive motor 5 is mechanically connected to the first wheel 3 whereas the second drive motor 6 is mechanically connected to the second wheel 4. According to an embodiment, the drive motors 5, 6 are in the form of brushless DC motors with suitable transmission units (not shown in FIG. 1 and FIG. 2) which are connected to each drive wheel 3, 4. However, other types of motor arrangements are possible within the scope of the invention.

Figure 3:
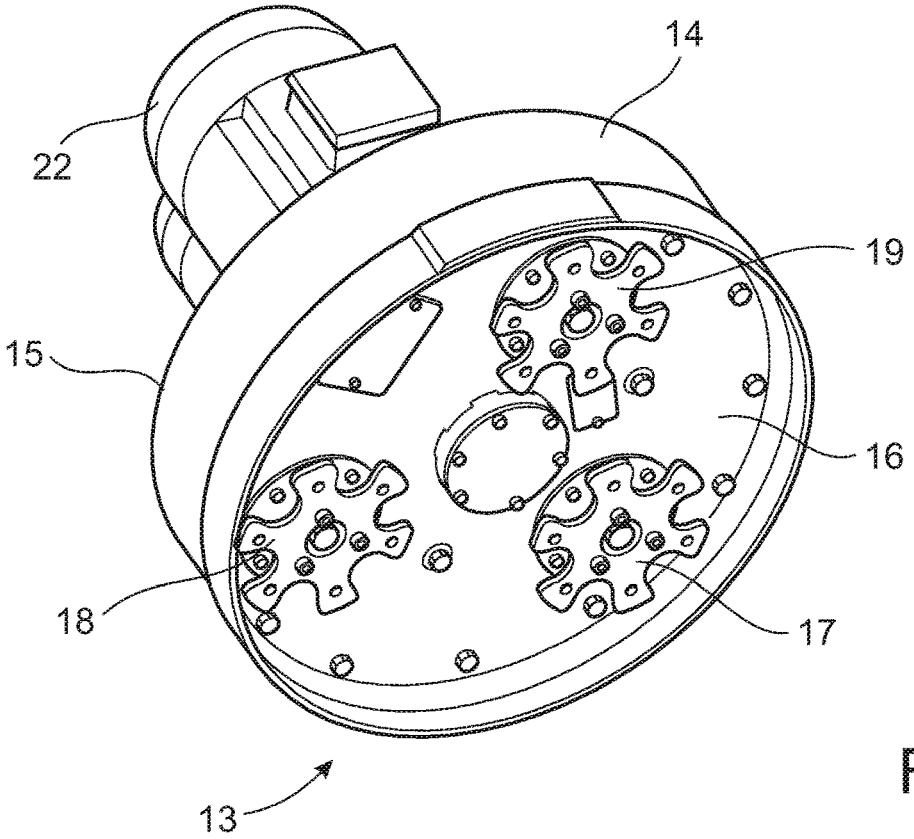
FIG. 3 shows a perspective view of the underside of a planetary head.

With reference to FIGS. 1 and 3, the floor surfacing machine 1 comprises a surfacing apparatus, according to an embodiment in the form of a planetary head 13 which is rotatably mounted to the frame 2 and comprises a cylindrical wall 14 which is closed at its upper end by means of a top plate 15 and at its lower end by means of a bottom plate 16 (not visible in FIG. 1 but shown in FIG. 3).

With reference to FIG. 3, showing a view from the underside of the planetary head 13, it can be noted that the floor surfacing machine comprises three satellite surfacing heads 17, 18, 19, including grinding discs, that are rotatably mounted within the circumference of the planetary head 13, where the satellite surfacing heads 17, 18, 19 are adapted for treating the floor surface 8 by means of for example grinding or polishing. The invention is not limited to machines having three satellite surfacing heads, i.e. the number of surfacing heads may vary.

Furthermore, with reference to FIG. 1, a motor mounting plate 20 is mounted above the planetary head 13. A third motor 21, with a gearbox 21*a*, is provided in order to drive the planetary head 13. Also, the floor surfacing machine 1 further comprises a fourth motor 22 which is mounted on the motor mounting plate 20 and which is arranged to drive the satellite surfacing heads 17, 18, 19 in a manner so that the planetary head 13 and the satellite surfacing heads 17, 18, 19 are independently operable.

Consequently, the third motor 21 and the fourth motor 22 define a motor arrangement and operate entirely independently, and as a result, the satellite surfacing heads 17, 18, 19 and planetary head 13 are driven independently and can be driven in a mutually opposing direction of rotation or in the same direction of rotation, and can be driven at different speeds independently of one another. The arrangement with independently driven satellite surfacing heads 17, 18, 19 and planetary head 13 provides enhanced control, stability and productivity for a remotely controlled floor surfacing machine 1.

It is previously known to arrange a floor surfacing machine with a planetary head 13 as shown in FIGS. 1-3, and the following is a brief description of the planetary head 13 and its function.

Figure 4:
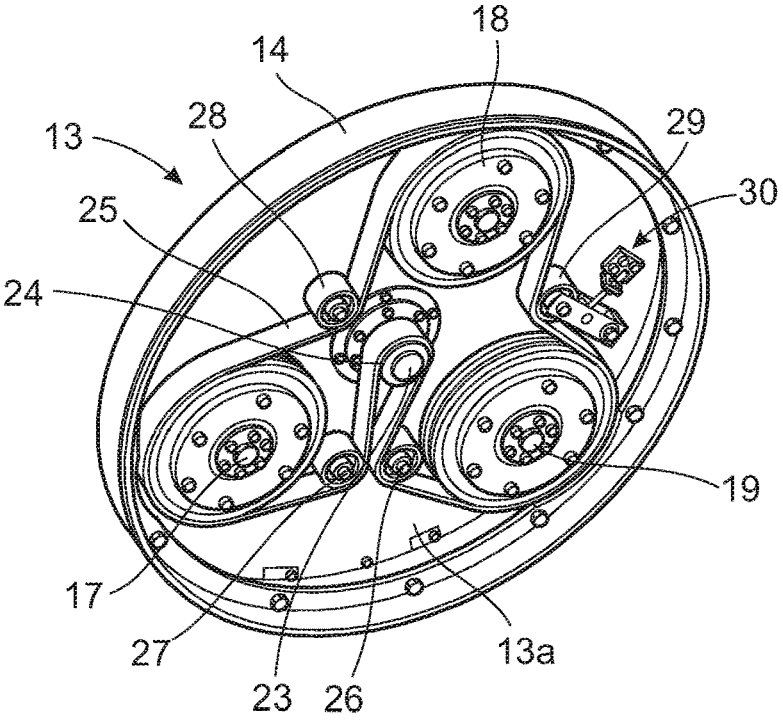
FIG. 4 shows a further perspective view of the underside of the planetary head.

With reference in particular to FIG. 3 and FIG. 4, wherein the bottom plate 16 shown in FIG. 3 has been removed in order to display the planetary head 13 more clearly, the fourth motor 22 is connected to a first motor axis 23 that extends through the top plate 15, and is connected to a first belt pulley 24 that is arranged to drive an endless belt 25 that further is guided by means of a second belt pulley 26, a third belt pulley 27, a fourth belt pulley 28 and a fifth belt pulley 29. Each one of the second belt pulley 26, third belt pulley 27, the fourth belt pulley 28 and the fifth belt pulley 29 is rotatably arranged so as to guide the endless belt 25 around the satellite surfacing heads 19, 20, 21 such that they are propelled when the fourth motor 22 drives the endless belt 25.

The fifth belt pulley 29 is attached, via a tensioning device 30, to a rotating part 13*a* of the planetary head 13. The tensioning device 30 is arranged to press the fifth belt pulley 29 against the endless belt 25 with a certain force, for example by means of a spring arrangement (not shown). In this way, the endless belt 25 is tightened around the belt pulleys 24, 26, 27, 28, 29 and the satellite surfacing heads 17, 18, 19 (which are shown without their grinding discs in FIG. 4) to a certain extent that suitably is adjustable by means of the tensioning device 30 which for this purpose is configured with a pivotable and adjustable arm connected to the top plate 15. The tensioning device 30 should also be releasable such that the endless belt 25 is untightened, for example if the endless belt 25 needs to be replaced.

Figure 5:
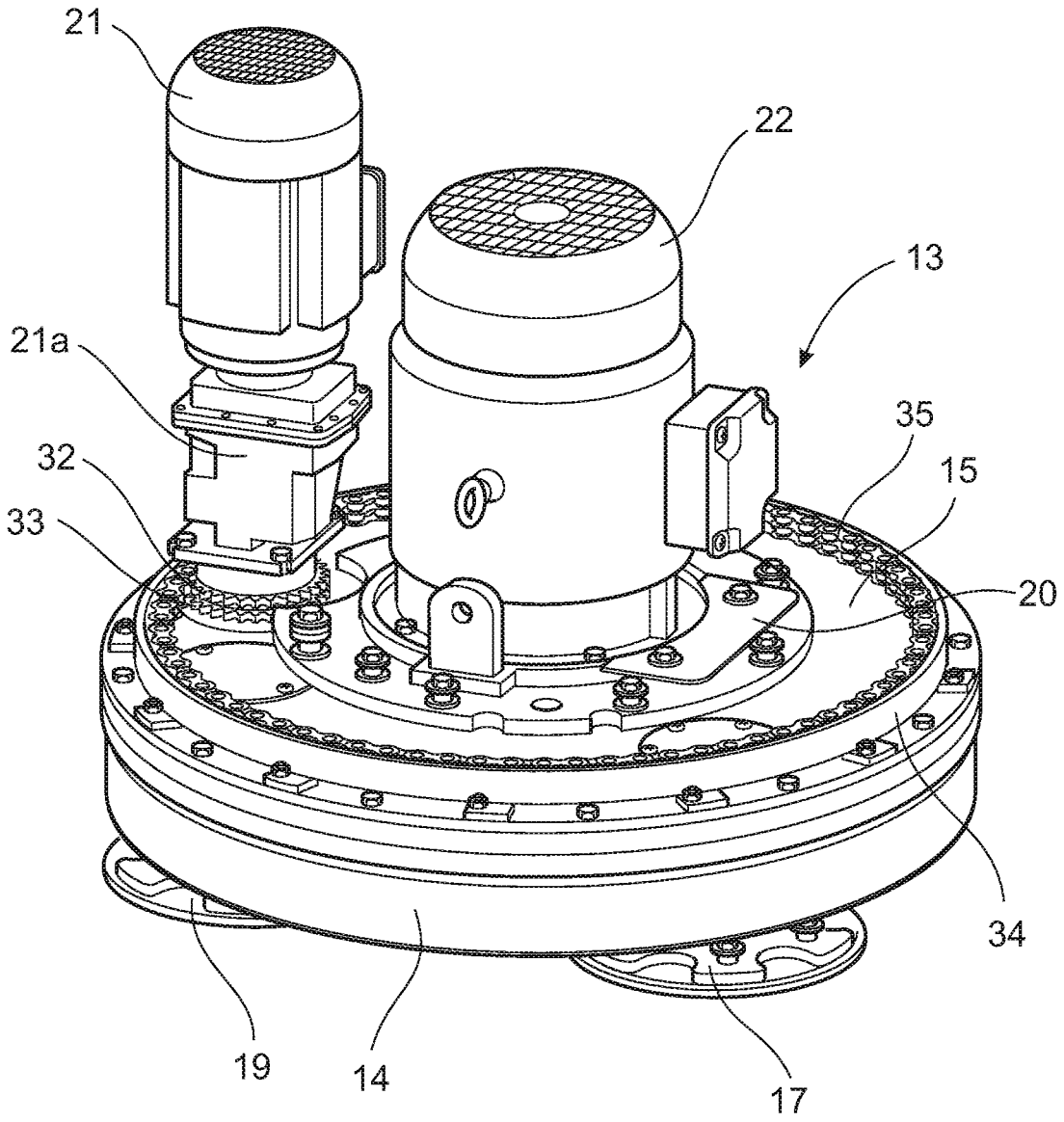
FIG. 5 shows a further perspective view of the planetary head.

As shown in FIG. 5, the third motor 21 is connected to its gear-box 21*a* from which a motor axis (not shown) extends. Two generally identical driving cog-wheels 32, 33 are attached to the second motor axis. Furthermore, the planetary head 13 comprises a circumferentially running top rim 34 that is mounted to the top plate 15. On the inner side of the top rim 34, a driving chain arrangement 35 is attached, suitably by welding. The driving chain arrangement 35 is arranged to engage the driving cog-wheels 32, 33 such that when the driving cog-wheels 32, 33 are propelled by means of the third motor 21, these rotate the chain arrangement 35 which in turn rotates the planetary head 13 to which it is attached via the top rim 34.

During manual operation, the handle control panel 12 is used for controlling, for example, the direction of rotation and the speed of the satellite surfacing heads 17, 18, 19, and the direction of rotation and speed of the planetary head 13. The handle control panel 12 can also be used for selecting between manual operation and remote operation.

During remote operation, the remote control 7 is also used for controlling, for example, the direction of rotation and the speed of the satellite surfacing heads 17, 18, 19, the direction of rotation and speed of the planetary head 13, and further relevant parameters.

The above are only examples of how the planetary head 13 and the satellite surfacing heads 17, 18, 19 are propelled by means of the third motor 21 and the fourth motor 22. Many other types of transmission arrangements are of course conceivable. For example, the third motor 21 may be arranged to propel the planetary head 13 by means of an endless belt that runs around the outer surface of the top rim, where the endless belt is connected to the third motor 21 by means of a pulley transmission arrangement (not shown).

The positions of the third motor 21 and the fourth motor 22 may be altered in dependence of how they are arranged to propel the planetary head 13 and the satellite surfacing heads 17, 18, 19.

The manner in which a floor surfacing machine 1 with a planetary head 13 as shown in FIGS. 1-5 is operated is previously known as such. For this reason, the operation of the machine 1 is not described in any further detail.

Figure 6:
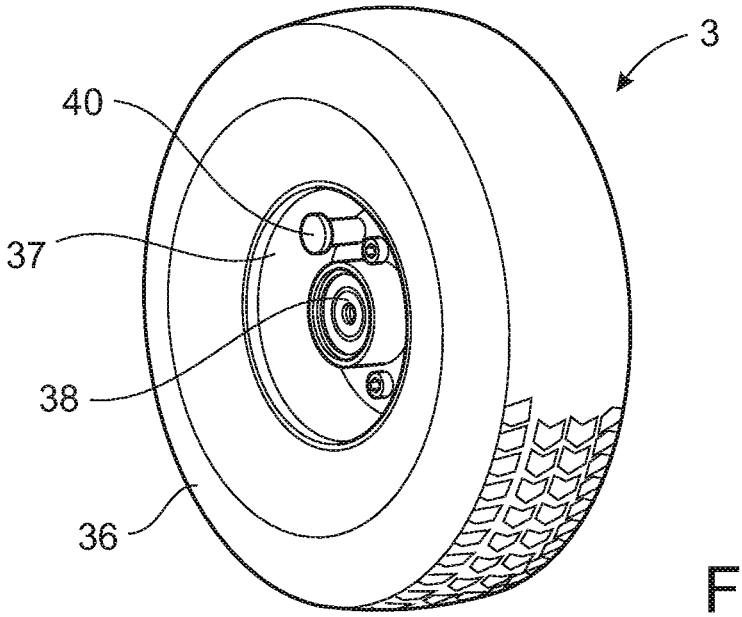
FIG. 6 shows a view of a drive wheel.
Figure 7:
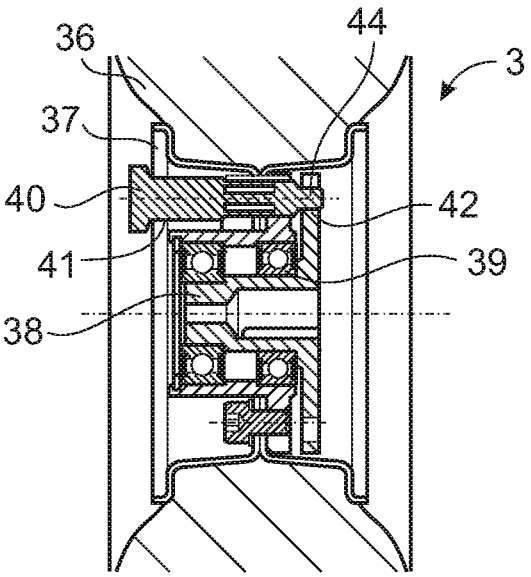
FIG. 7 shows a cross-sectional view of the drive wheel according to FIG. 6.

FIG. 6 shows a perspective view of the first drive wheel 3. FIG. 7 shows a cross-sectional view of said first drive wheel 3. The second driving wheel 4 (not shown in FIG. 6 or 7) is constructed in a similar manner as the first drive wheel 3. As shown in FIG. 6 and FIG. 7, the first drive wheel 3 comprises a tyre 36 which is mounted on a rim 37, and furthermore a wheel hub 38 which is configured for carrying a drive axle shaft (not shown in FIG. 6) of the first drive motor 5. The wheel hub 38 is supported by means of a wheel bearing 39 (see FIG. 7).

Furthermore, a locking pin 40 is used in order to lock the wheel 3 to the corresponding drive motor 5 during operation. As mentioned initially, it is of high importance that the wheel 3 is locked in this manner before grinding operation by means of the planetary head 13 is started. As explained, this is particularly important during remote operation of the floor surfacing machine 1 by means of the remote control 7. For this reason, the locking pin 40 is arranged as shown in FIG. 7 in a manner so that it extends through a bore 41 in the wheel rim 37 and also through a further bore 42 in the wheel hub 38. In this manner, the wheel 3 is locked so that it rotates when the corresponding drive motor axle rotates.

Figure 8:
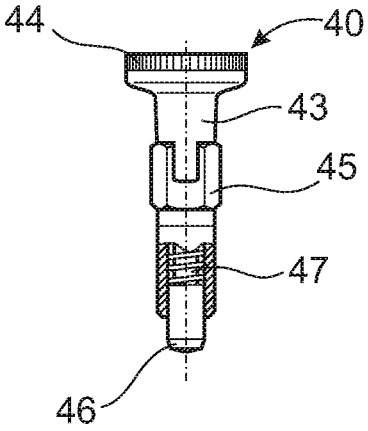
FIG. 8 shows a cross-sectional view of a locking pin.

FIG. 8 shows the locking pin 40 in greater detail. The locking pin 40 comprises a pin element 43 with a head 44, wherein the pin element 43 extends inside a cylindrical sleeve 45. Furthermore, the pin element 43 can be displaced longitudinally inside the sleeve 45 so that the tip 46 of the locking pin 40 protrudes outside the sleeve 45. Also, the locking pin 40 comprises a spring element 47 which acts so as to force the tip 46 of the locking pin 40 in a direction towards the bore 42 in the wheel hub 38.

With reference to FIG. 7, the locking pin arrangement 40 can be mounted in the wheel rim 37 so that it may assume two different positions. FIG. 7 shows the locking pin 40 in a locked position, i.e. when the first drive wheel 3 is arranged so that the pin tip 46 extends into the corresponding bore 42 in the wheel hub 38, i.e. so that the rim 37 is locked to the wheel hub 38. This means that the wheel 3 will rotate when the first drive motor 5 is connected to the wheel hub 38 via its axle shaft. This condition is used when the grinding operation is about to be initiated by an operator.

Also, according to the embodiment, the locking pin 40 is arranged to assume a further position, i.e. a position in which it does not extend through the bore in the wheel hub 38 but instead so that the tip 46 of the locking pin 40 is withdrawn from the bore 42 in the wheel hub 38.

It should be noted that the locking pin 40 is mounted in the rim 37 during both its active and inactive position. In order to move the locking pin to an inactive position, the pin element 43 is pulled out in relation to the sleeve 45 (so that the tip 46 is no longer inserted into the hub 38) after which the pin element is turned in relation to the sleeve in order to lock the locking pin 40 in its inactive position.

In order to move the locking pin 40 to its active position, the pin element 43 is turned back, so that the tip 46 is forced towards its active position by means of the spring element 47. More precisely, the locking pin 40 can be pushed into a bore of the hub 38 by rotating the hub 38. To this end, the hub 38 is provided with a plurality of bores so that the locking pin 40 easily can be positioned into one of them.

The locking pin 40 may be in its unlocked condition for example when the floor surfacing machine 1 is to be operated manually, i.e. without assistance from the drive motors 5, 6. However, during remote operation, it is essential that the locking pin 40 is positioned in its locked condition before the planetary head 13 is operated.

Figure 9:
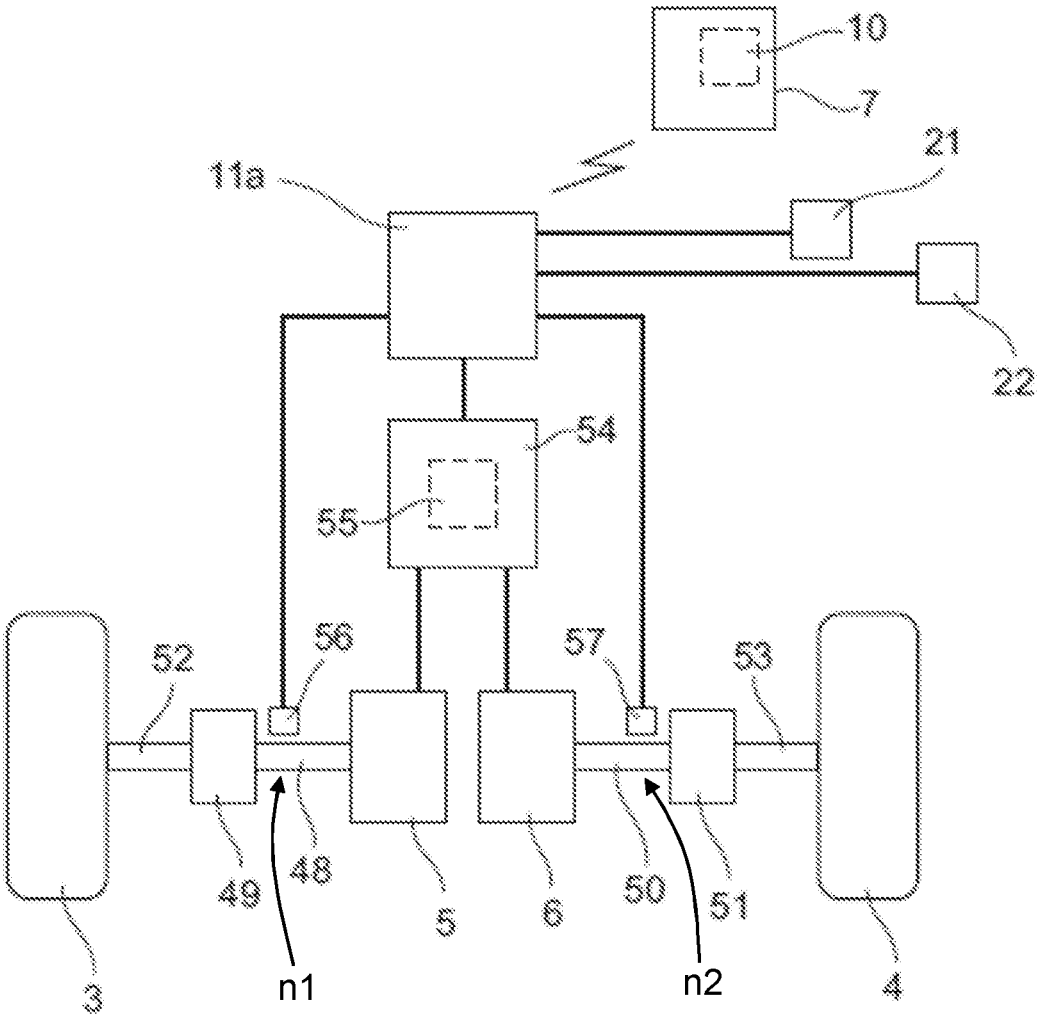
FIG. 9 is a schematic view of an embodiment of the invention.

FIG. 9 is a schematic view of an embodiment involving a safety arrangement for the floor surfacing machine as described above and disclosing the first wheel 3 which is operated by means of the first drive motor 5 and the second wheel 4 which is operated by means of the second drive motor 6. The first drive motor 5 has a first output axle 48 which is connected to a first transmission 49 and the second drive motor 6 has a second output axle 50 which is connected to a second transmission 51. The first transmission 49 is connected to the first drive wheel 3 via a first drive axle 52, whereas the second transmission 51 is connected to the second drive wheel 4 via a second drive axle 53.

In the embodiment shown in FIG. 9, the drive motors 5, 6 are configured so as be operated by means of the remote control 7, which is provided with a control unit 10 as mentioned above. During remote operation of the floor grinding machine 1, the control unit 10 is configured for communicating in a wireless manner with a main control unit 11*a* arranged inside an electrical cabinet (see also FIG. 1). The main control unit 11*a* is not visible in FIG. 1 but is shown in a schematical manner in FIG. 9. In this manner, the remote control 7 can be connected remotely to the main control unit 11*a* in order to control the drive motors 5, 6. Other parameters involving the operation of the floor surfacing machine 1 can also be controlled by means of the remote control 7, such as the speed and direction of rotation of the planetary head 13 and the satellite surfacing heads 17, 18, 19 by means of the third motor 21 and the fourth motor 22, respectively.

The embodiment shown in FIG. 9 also comprises a power supply 54 for the drive motors 5,6 which is shown in a schematical manner. The power supply 54 is controlled by means of the main control unit 11*a* and is also associated with a current measuring unit 55 which is configured for measuring the current supplied by the power supply 54 to each one of the two drive motors 5, 6. Even though the current measuring unit 55 is arranged for measuring the current supplied to each individual drive motor 5, 6 it is shown schematically as a single unit in FIG. 9.

FIG. 9 also shows a first Hall sensor 56 for sensing the rotational speed n1 of the first output axle 48 and also a second Hall sensor 57 for sensing the rotational speed n2 of the second output axle 50. The two Hall sensors 56, 57 are connected to the main control unit 11*a*.

It is an object of the invention to ensure that the wheel 3 is locked by means of the locking pin 40 before grinding operation by means of the planetary head 13 is initiated by the operator. For this purpose, and according to an embodiment, the current supplied to each drive motor 5, 6 is measured by means of the current measuring unit 55. The current drawn by each motor 5, 6 can be said to correspond to the torque provided by each corresponding wheel 3, 4 during operation.

If the measured current i1 to the first drive motor 5 is relatively high, the torque which is required for attempting to rotate the wheel 3 via the first drive axle 52 is considered to be relatively high. This is interpreted by the main control unit 11*a* as an operating condition in which the wheel 3 rotates with a substantial amount of resistance, i.e. a situation in which the wheel 3 is in fact locked by means of its locking pin 40.

If, on the other hand, the current i1 to the first drive motor 5 is relatively low, the torque which is required for rotating the wheel 3 is relatively low. This is interpreted by the control unit 11 as an operating condition in which the drive motor 5 rotates easily, i.e. a situation in which the wheel 3 is not locked by means of its locking pin 40.

Similar current measurements as described can be carried out also for the second drive motor 6 and the second wheel 4.

If it is determined that at least one of the drive wheels 3, 4 is considered to be unlocked, as described above, certain safety measures will be actuated in order to prevent operation of relevant parts of the surfacing apparatus 13 (see also FIG. 1). According to an embodiment, the operation of the third motor 21 and the fourth motor 22 (see description above) will then be shut off. Optionally, it is also suitable to shut off the wheel engines 5, 6. As a further suitable measure, a sound signal or light signal, or both, can be generated so as to inform the user of the floor surfacing machine 1 that at least one of the drive wheels 3, 4 is not locked by means of a locking pin 40. Finally, an indication that at least one of the wheels 3, 4 is unlocked can be indicated on a display (not shown in the drawings) forming part of the remote control 7 (see FIG. 1). In this way, a user of the machine 1 is informed of the situation.

According to an embodiment, the safety measures mentioned above are carried out through control by means of the main control unit 11*a*.

It should be noted that the above-mentioned torque measurements, i.e. the tests for determining whether each wheel 3, 4 is locked by its locking pin, are carried out in connection with a start-up sequence for the floor surfacing machine. Suitably, this start-up sequence is executed during a relatively short time period immediately after a start of the floor surfacing machine, i.e. after the two drive motors 3, 4, the third motor 21 and the fourth motor 22 have been started and the grinding operation is about to be initiated by an operator. In this manner, there is no risk that the above-mentioned measures for shutting down the third motor 21 and the fourth motor 22 and generating sound or light signals, will be necessary in the event that the floor surfacing machine is operated in a slight downslope, which results in a relatively low torque acting upon the drive wheels 3, 4.

According to a further embodiment, the main control unit 11*a* is arranged for determining the rotational speed n1, n2 of the two output axles 48, 50 as detected by means of the Hall sensors 56, 57. If the rotational speed n1 of the first output axle 48 is relatively high, this corresponds to a condition in which the torque required for rotating the corresponding wheel 3 is relatively low. This is interpreted by the main control unit 11*a* as a situation in which the first output axle 48 rotates relatively freely, i.e. a situation in which the wheel 3 is not locked by means of its locking pin 40.

If, on the other hand, the rotational speed n1 of the first drive wheel 3 is relatively low, it can be expected that the torque which is required for rotating the first wheel 3 is relatively high. This is interpreted by the main control unit 11*a* as a situation in which the drive motor 5 rotates with a certain amount of resistance, i.e. a situation in which the wheel 3 is in fact locked by means of its locking pin 40.

Based on the above-mentioned situations, the main control unit 11*a* is configured for preventing operation of the planetary head 13 and the satellite surfacing heads 17, 18, 19, i.e. preventing operation of the third motor 21 and the fourth motor 22, if said required torque is lower than a predetermined limit value. Such a limit value is adapted so as to correspond to a rotational speed of the axle 48 which clearly is indicative of a condition in which the locking pin 40 is not in place so as to lock the wheel 3.

According to a further embodiment, measurements related to both the current to the drive motors 5, 6 and also the rotational speed of the drive wheels 3, 4 can be combined in order to determine whether any of the drive wheels 3, 4, can be considered to be unlocked. For example, a current measurement can be carried only when any, or each, of the wheels 3, 4 rotates with a speed which is higher than a predetermined threshold speed.

In practical terms, the main control unit 11*a* is configured so that when an operator activates the main control unit 11*a* during a start-up phase of the floor surfacing machine 1, there is a control whether the drive motors 5, 6 can run without essentially any resistance. If this is the case, this means that the drive wheels 3, 4 are not locked by the spring pin 40. As a consequence, operation of the surfacing apparatus in the form of the planetary head 13 is prevented. If, on the other hand, the torque for operating the drive wheels 3, 4 is higher than a certain threshold value, the operation of the planetary head 13 and the satellite surfacing heads 17, 18, 19 can be started.

The invention is not limited to the above, but may vary freely within the scope of the dependent claims. For example, other sensor types can be used instead of the Hall sensors, for example torque sensor devices being associated with each outgoing axle of a corresponding drive motor.

Also, the remote unit 7 may be arranged to communicate with the main control unit 11*a* by means of other means than radio signals, for example optical or sonic signals. The remote unit 7 can in principle also be connected to the main control unit 11*a* via an electric wire.

The invention claimed is:

1. A floor surfacing machine comprising:

a first drive wheel and a second drive wheel coupled to a frame of the floor surfacing machine, a first motor for propelling said first drive wheel and a second motor for propelling said second drive wheel, a surfacing apparatus coupled to the frame of the floor surfacing machine, a control unit for controlling the operation of each of the first motor, the second motor, and the surfacing apparatus, at least one detecting unit connected to said control unit and adapted for determining configured to determine a torque for each of the first and the second drive wheel, and wherein in response to the detecting unit detecting the torque of either the first drive wheel or the second drive wheel being lower than a predetermined torque limit, said control unit is configured to prevent operation of at least one of said surfacing apparatus or said first and second motors.

2. A floor surfacing machine according to claim 1, wherein the first motor and the second motor are each a brushless DC motor.

3. A floor surfacing machine according to claim 1, wherein said surfacing apparatus comprises a planetary head and at least one satellite surfacing head which is rotatably mounted on the planetary head, and wherein the floor surfacing machine further comprises a third motor for propelling said planetary head and said at least one satellite surfacing head.

4. A floor surfacing machine according to claim 3, wherein said a third motor is arranged to propel the at least one satellite surfacing head, and wherein the floor surfacing machine further comprises a fourth motor arranged to propel the planetary head, such that the planetary head and the satellite surfacing heads are independently operable.

5. A floor surfacing machine according to claim 1, wherein said detecting unit comprises a current measuring unit being configured for detecting the current supplied to the first motor and the second motor, said current drawn by each of the first motor and the second motor corresponding to the torque for each corresponding drive wheel.

6. A floor surfacing machine according to claim 1, wherein said detecting unit comprises a Hall sensor configured for detecting a rotational speed of a corresponding output axle of the first motor and the second motor, the rotational speed of the corresponding output axle corresponding to the torque for each corresponding drive wheel.

7. A floor surfacing machine according to claim 1, wherein said control unit is configured to be controlled by a remote control.

8. A floor surfacing machine according to claim 6, wherein each of the first drive wheel and the second drive wheel is associated with a locking pin being configured to lock the respective first drive wheel and the second drive wheel to said corresponding output axle.

9. A floor surfacing machine according to claim 3, wherein said control unit is configured to prevent operation of said surfacing apparatus by shutting off the third motor.

10. A method of operating a floor surfacing machine having a first drive wheel and a second drive wheel coupled to a frame of the floor surfacing machine, a first motor for propelling the first drive wheel and a second motor for propelling the second drive wheel, and a surfacing apparatus coupled to the frame of the floor surfacing machine, said method comprising:

controlling the operation of the first motor, the second motor, and the surfacing apparatus by a control unit;

determining a torque of each of the first drive and the second drive wheel;

determining whether said torque of either the first drive wheel or the second drive wheel is lower than a predetermined torque limit; and in response to the torque of either the first drive wheel or the second drive wheel being lower than the predetermined torque limit, preventing operation of at least one of said surfacing apparatus or said first and second motors.

11. A method according to claim 10, wherein said method further comprises:

measuring the current being supplied to each of the first motor and the second motor, said current corresponding to the torque for each corresponding drive wheel; and in response to the current of either the first motor or the second motor being lower than a predetermined current limit, preventing operation of the surfacing apparatus.

12. A method according to claim 10, wherein said method further comprises:

measuring a rotational speed of an output axle of each of the first drive wheel and the second drive wheel, said rotational speed corresponding to the torque for each corresponding drive wheel; and in response to the rotational speed of the output axle of either of the first drive wheel or the second drive wheel being higher than a predetermined rotational limit, preventing operation of the surfacing apparatus and/or first and second motors.

13. A method according to claim 10, said surfacing apparatus comprising a planetary head propelled by a third motor, wherein said method further comprises:

preventing operation of the surfacing apparatus by shutting off the third motor.

* * * * *